United States Patent [19]

Poulos et al.

[11] 4,268,379

[45] May 19, 1981

[54] SELECTIVE FLOCCULATION FOR INCREASED COAL RECOVERY BY FROTH FLOTATION

[75] Inventors: Andrew C. Poulos, Lakeland, Fla.; John D. Hightower, Abingdon, Va.

[73] Assignee: American Cyanamid Company, Stamford, Conn.

[21] Appl. No.: 864,132

[22] Filed: Dec. 23, 1977

[51] Int. Cl.[3] ..... B03B 1/04

[52] U.S. Cl. ..... 209/5; 209/166; 210/735

[58] Field of Search ..... 209/166, 5; 210/54 R, 210/54 C; 44/1 R

[56] References Cited

U.S. PATENT DOCUMENTS

| | | | |
|---|---|---|---|
| Re. 28,807 | 5/1976 | Panzer | 210/54 C X |
| Re. 28,808 | 5/1976 | Panzer | 210/54 C X |
| 2,740,522 | 4/1956 | Aimone | 209/166 |
| 3,023,162 | 2/1962 | Fordyce | 210/54 C |
| 3,138,550 | 6/1964 | Woolery | 209/166 X |
| 3,171,805 | 3/1965 | Suen | 210/54 C |
| 3,278,506 | 10/1966 | Chamot | 210/54 C X |
| 3,452,867 | 9/1969 | Bishop | 209/166 |
| 4,090,955 | 5/1978 | Dexter | 209/5 |

FOREIGN PATENT DOCUMENTS

| | | | |
|---|---|---|---|
| 684133 | 9/1962 | Canada | 209/5 |
| 1002702 | 2/1957 | Fed. Rep. of Germany | 209/166 |
| 826121 | 12/1937 | France | 209/160 |

*Primary Examiner*—Robert Halper

*Attorney, Agent, or Firm*—W. J. VanLoo; P. W. Leuzzi, II

[57] ABSTRACT

The use of a selective cationic polymeric flocculant in conjunction with froth flotation of coal results in increased coal recovery.

11 Claims, No Drawings

SELECTIVE FLOCCULATION FOR INCREASED COAL RECOVERY BY FROTH FLOTATION

This invention relates to an improved process for recovering coal by froth flotation. More particularly, this invention relates to a froth flotation process for coal recovery wherein a selective flocculant is employed to flocculate clay slimes associated with the coal values and free the coal surfaces for flotation.

Coal is the largest available energy (fossil fuel) source known today and will become an important energy source for the future in view of the continuing depletion of crude oil sources. Coal, as obtained from mining operations, is recovered in a variety of particle sizes contaminated with clay. The clay is readily washed from the surfaces of the larger coal particles, but a significant quantity of coal values of small particles is present in the clay slimes. Coal values from the clay slimes are conventionally recovered by froth flotation using a frothing agent in conjunction with a hydrocarbon oil. It is estimated that by 1981 over 45 million tons of coal will be recovered by froth flotation. In spite of the huge quantities of coal recovered by conventional froth flotation procedures, a significant quantity of coal values are not recovered and represents an unnecessary loss of energy source.

What is needed, therefore, is an improved process for coal recovery by froth flotation which results in greater amounts of recovered coal. Such a development would further extend our coal resources and enable greater energy yields to be obtained from normal mining operations. It would also be desirable if such added recovery could be achieved without a significant increase in the ash content of the coal obtained, that is the grade of the coal recovered is not materially lowered. The provision for such an improved froth flotation process would fulfill a long-felt need and constitute a significant advance in the art.

In accordance with the present invention, there is provided a process for recovering coal by froth flotation which comprises classifying the coal to provide particles of flotation size, slurrying the classified coal particles in aqueous medium, conditioning the slurry with effective amounts of frother, hydrocarbon oil, and cationic polymeric flocculant selective for clay slimes, and froth floating the desired coal values while flocculating clay slimes.

The process of the present invention greatly increases the recovery of coal values over that obtained by the conventional froth flotation procedure. In preferred embodiments, an increase of 20% in recovery was accompanied by only a 2% increase in ash content. This recovery could account forover 1.5 million additional tons of coal per year.

In carrying out the process of the present invention, the coal is classified in accordance with conventional procedures to provide coal particles of flotation size. Typically, these particles result from prior processing and are in admixture with clay slimes. Thus, no new processing steps or teachings are required to conduct this step.

After the coal has been classified as indicated, it is next slurried in aqueous medium. In instances where the coal particles are already present in aqueous medium, it is only necessary to adjust the content of aqueous medium to provide a flotation feed. Again, no new processing steps or teachings are necessary to conduct this step.

After the slurry has been prepared as indicated, it is next conditioned with a frothing agent, a hydrocarbon oil, and a cationic polymeric flocculant selective to clay slimes, said conditioning agents being used in effective amounts for froth flotation. The dosages of frothing agent and hydrocarbon oil will be according to conventional requirements so that no new teachings are necessary with respect thereto. The particular amount of cationic polymeric flocculant selective to clay slimes that is effective in any given instance will vary depending upon many factors such as the specific cationic polymeric flocculant selected, the nature and amount of clay slimes present, the particular values of recovery and ash content desired, and the like. In any event, the effective amount can readily be determined by trial using the teachings of the examples which follow as a guide. Generally, an effective amount will be found in the range of about 0.1 to about 2.0 pounds per ton of solids processed, preferably about 0.25 to 1.0 lb. per ton, same basis.

During conditioning of the slurry, flocculation of the clay slimes will occur, thus promoting increased recovery of coal. It is desirable, therefore, to conduct conditioning in a manner such as to encourage such flocculation. Flocculation can generally be encouraged by increasing initial mixing during conditioning and increasing the time of conditioning, although such processing is not essential to effective operation of the present invention.

After the slurry has been conditioned as indicated, it is subjected to froth flotation following conventional procedures. As a result of the use of the selective flocculant for the clay slimes in accordance with the present invention, more coal will be recovered with the froth.

As the cationic polymeric flocculant selective for clay slimes, as that and similar terms are used herein and in the appended claims, is meant a cationic polymeric flocculant that primarily flocculates clay slimes and is inactive with respect to coal particles. By selectively flocculating the clay slimes, it is thought that the surfaces of the coal particles are more effectively cleaned and thus more receptive to froth flotation.

Cationic polymeric flocculants selective for clay slimes include a variety of types in a wide range of molecular weights. Typical cationic polymeric flocculants include the reaction product of dimethylamine and epichlorohydrin; the reaction product of dimethylamine, a polyfunctional amine and epichlorohydrin; the reaction product of methylamine and epichlorohydrin subsequently quaternarized with, for example, dimethyl sulfate; copolymers of acrylamide and dimethylaminoethylmethacrylate quaternarized with dimethyl sulfate; copolymers of acrylamide and diallyldimethylammonium chloride; quaternarized Mannich bases of polyacrylamide; and the like. Any cationic polymeric flocculant that has selective activity with respect to clay slimes containing coal values, may be employed in the process of the present invention which relates to the concept of selective flocculation of clay slimes in conjunction with the froth flotation of coal values. A preferred type of cationic polymeric flocculant for use in the process of the present invention is the reaction product of dimethylamine and epichlorohydrin. Although a wide range of polymer molecular weights is effective in the process of the present invention, it is generally preferred to use those of relatively low molecular weights.

Where molecular weight values are available, the range preferred is generally about 25,000 to about 100,000. Where the polymer molecular weight is indicated by solution viscosity, the preferred values will generally run from about 50 to about 1,000 centistokes as a 0.5 weight percent or higher solution in water at 25° C.

The invention is more fully illustrated in the examples which follow wherein all parts and percentages are by weight unless otherwise specified.

EXAMPLE 1

A flotation feed of clay slimes and coal particles employed in a stream coal preparation plant was used for a series of runs. In one run, the normal froth flotation procedure was carried out using as frothing agent 0.4 lbs./ton of solids of a $C_6$–$C_8$ alcohol mixture in conjunction with 1.72 lbs./ton of No. 5 Fuel Oil. In a series of additional runs, the same procedure was followed except that varying amounts of a cationic polymeric flocculant were also used. The cationic polymeric flocculant was a 95:5 copolymer of acrylamide and the dimethyl sulfate quaternary of dimethylaminoethyl methacrylate having a Brookfield viscosity of about 650 cps. at 0.5% solids at 25° C. Dosages of polymer and results of the various runs are given in Table I which follows:

TABLE I

Froth Flotation of Coal With Cationic Polymeric Flocculant

| Run | Flocculant Dosage lbs/ton | Coal Recovery Weight (%) | Dry Ash % | Increased Recovery* Due to Flocculant (%) |
|---|---|---|---|---|
| 1 | 0 (Control) | 34.68 | 21.26 | — |
| 2 | 0.25 | 39.66 | 23.99 | 14.4 |
| 3 | 0.50 | 41.23 | 26.96 | 18.9 |
| 4 | 1.01 | 42.26 | 33.90 | 21.9 |
| 5 | 1.51 | 43.32 | 36.12 | 24.9 |

*Based on control recovery percent.

These results show that increased coal recovery is obtained by use of the selective cationic polymeric flocculant and that increased recovery is obtained with increasing polymer usage. This polymer, of relatively high molecular weight, caused increases in the ash content of the recovered coal.

EXAMPLE 2

The procedure of Example 1 was followed in every material detail except for the cationic polymeric flocculant employed. In this series of runs the cationic polymeric flocculant was the reaction product of dimethylamine and epichlorohydrin having a solution viscosity (Brookfield) at 25° C. of about 500 to 1000 centipoise as a 50% aqueous solution. Polymer dosage and results are given in Table II which follows:

TABLE II

Froth Flotation of Coal With Cationic Polymeric Flocculant

| Run | Flocculant Dosage (lbs./ton) | Coal Recovery Weight (%) | Dry Ash % | Increased Recovery* Due to Flocculant (%) |
|---|---|---|---|---|
| 1 | 0 (Control) | 49.58 | 22.29 | — |
| 2 | 0.25 | 59.48 | 22.79 | 20.0 |
| 3 | 0.50 | 58.90 | 23.37 | 18.8 |
| 4[1] | 0.50 | 61.39 | 24.93 | 23.8 |
| 5 | 1.00 | 61.97 | 28.08 | 25.0 |

*See TABLE I

[1]Flotation feed at 7.05% solids. In all other runs, including those of Example 1, flotation solids was 14.1%.

These data again show the improved results obtained by employing a cationic polymeric flocculant in conjunction with coal recovery by froth flotation. In Run 2, an increase of 20% in coal recovery was obtained with an increase in ash content of only 2%. Run 4 compared to Run 3 shows that some improvement can be obtained by decreasing the solids of the flotation feed.

We claim:

1. A process for recovering coal from a clay slime containing coal ore by froth flotation which comprises classifying the coal to provide particles of flotation size, slurrying the classified coal particles in aqueous medium, conditioning the slurry with effective amounts of frothing agent, hydrocarbon oil, and cationic polymeric flocculant selective for clay slimes, and froth floating the desired coal values while flocculating clay slimes.

2. The process of claim 1 wherein the cationic polymeric flocculant is the reaction product of dimethylamine and epichlorohydrin.

3. The process of claim 2 wherein the cationic polymeric flocculant has a solution viscosity in the range of about 500 to about 1000 centistokes of 25° C. as a 50 weight percent or higher aqueous solution.

4. The process of claim 2 wherein said cationic polymeric flocculant is used at a dosage of about 0.25 to 1.0 pounds per ton of solids.

5. The process of claim 1 wherein the cationic polymer flocculant is a 95:5 copolymer of acrylamide and the dimethyl sulfate of quaternary of dimethylaminoethyl methacrylate.

6. The process of claim 5 wherein the copolymer has a solution viscosity in the range of about 50 to 1000 centistokes as a 0.5 weight percent aqueous solution.

7. The process of claim 6 wherein said cationic polymeric flocculant is used at a dosage of about 0.25 to 1.0 pounds per ton of solids.

8. The process of claim 5 wherein the copolymer has a solution viscosity of about 650 cps. as a 0.5 weight percent aqueous solution.

9. The process of claim 1 wherein said cationic polymeric flocculant is used at a dosage level of about 0.25 to 1.0 pounds per ton of solids.

10. A process for improving the recovery of clean coal which comprises adding an effective amount of a water soluble cationic polymer to the coal being processed to decrease the amount of clay in the aqueous coal suspension being treated.

11. A process as in claim 10 wherein the effective amount is at least 0.1 pounds per ton based on the weight of the dry flotation feed.

* * * * *